US005669553A

United States Patent [19]

Smith

[11] Patent Number: 5,669,553

[45] Date of Patent: Sep. 23, 1997

[54] INSULATING CUP SLEEVE

[75] Inventor: Ernest L. Smith, Kansas City, Mo.

[73] Assignee: Sealright Co., Inc., DeSoto, Kans.

[21] Appl. No.: 689,361

[22] Filed: Aug. 8, 1996

[51] Int. Cl.[6] ..... B65D 3/22

[52] U.S. Cl. ..... 229/403; 220/738; 220/739

[58] Field of Search ..... 229/400, 403; 220/737, 738, 739, 648, 649; 294/31.2, 131, 165

[56] References Cited

U.S. PATENT DOCUMENTS

| | | | |
|---|---|---|---|
| Re. 25,618 | 7/1964 | Goodman | 229/403 |
| 549,394 | 11/1895 | Presnell . | |
| 2,028,566 | 1/1936 | Seipel et al. . | |
| 2,192,415 | 3/1940 | Schwarzenzer . | |
| 2,563,352 | 8/1951 | Morse | 229/403 |
| 3,079,027 | 2/1963 | Edwards | 229/400 |
| 3,232,512 | 2/1966 | Wanderer . | |
| 3,596,795 | 8/1971 | Ercoli . | |
| 4,548,349 | 10/1985 | Tunberg . | |
| 4,552,276 | 11/1985 | Bush . | |
| 4,671,424 | 6/1987 | Byrns | 220/739 |
| 4,726,553 | 2/1988 | Wischusen . | |
| 4,928,848 | 5/1990 | Ballway . | |
| 5,143,247 | 9/1992 | Gavle . | |
| 5,425,497 | 6/1995 | Sorenson | 220/738 |

*Primary Examiner*—Gary E. Elkins

*Attorney, Agent, or Firm*—Kircher, Bowman & Johnson

[57] ABSTRACT

An insulating sleeve, preferably made of plastic, adapted to slidably receive and engage the outer sidewall of a container such as a cup. The sleeve is comprised of a plurality of concentric ring-like bands aligned one above the other and connected so as to form a unitary sleeve by peripheral ridges extending from the bottom edge of one band to the top edge of the next adjacent band. The sleeve is configured such that the top edge of each band rests in abutting engagement or contact with the sidewall when fitted around the container, with the remainder of the band and the associated ridge being located remote from contact with the container sidewall. A circular void or channel is thereby formed around the container between portions of the sleeve and the sidewall within an area defined by the top edges of adjoining bands. Heat or cold emanating from the container is accumulated within these channels and vented out the top of the sleeve via a series of notched vents provided within the top edge of each band.

15 Claims, 1 Drawing Sheet

INSULATING CUP SLEEVE

BACKGROUND OF THE INVENTION

1. Field of Invention

The present invention is generally directed to an article of manufacture for use in conjunction with beverage cups of the type having a smooth cylindrical or tapered sidewall and no handle. More particularly, the present invention is directed to an insulating sleeve configured to slidably receive and securely fit around a beverage cup such that the sleeve insulates the user's hand against heat emanating from the cup and assists the user in firmly grasping and handling the cup.

2. Description of Background Art

Disposable paper or plastic beverage cups of the type having a smooth cylindrical or tapered sidewall with no handle are commonly used by coffee shops, fast food restaurants, convenience stores and the like. These cups have many advantages insofar as they are easy to dispense (generally from a cylindrical dispenser), may include graphics or written indicia on the outer sidewall for promotional purposes and are relatively inexpensive to make.

There are some disadvantages associated with these style cups, however, primarily relating to problems that a user may encounter in grasping, carrying and using the cups. Insofar as the disposable cup has a smooth outer surface, a user generally has to grasp the cup by placing his or her entire palm and fingers around the outside surface of the cup. If the user's hands are wet or dirty or if the user loosens his or her grip, the cup may partially slip or entirely drop out of the user's hand spilling the beverage on the user, the floor, etc.

Another related problem is that the paper or plastic material used to make these cups often times does not provide a sufficient amount of insulation to prevent the outside of the cup from getting hot when filled with hot chocolate, coffee, or the like. Since these cups do not have handles, the user is required to contact his or her entire palm around the cup, and heat generated from the hot beverage can result in discomfort to the user when handling the cup. This discomfort may become so great as to cause the user to drop the cup or to delay drinking the beverage until it has cooled to an undesirable temperature.

In order to overcome these problems, it has been suggested to provide a handle made of paper or other sheet-like material to assist the user in holding the cup. This handle may be formed within the sidewall of the cup or may be provided as an attachment such as on a sleeve to be fitted around the cup. While these handle designs overcome some of the problems noted above, they are not without drawbacks. For example, these handles generally require some amount of assembly before use making them less convenient to the server and/or user. The unitary handle cups may also be more difficult to dispense from commonly used cylindrical dispensers, since parts of the handle can get caught within the dispenser and tear when the user pulls the cup out of the dispenser.

Another problem associated with using handles made out of paper or other sheet-like material, is that these handles may lack sufficient strength to hold the cup in an upright position when the user is holding the cup by the handle. The weight of the cup can cause the handle to sag or tear such that the cup will tilt, spilling the beverage. Furthermore, the inside edge of these handles forms a relatively sharp edge which may rub against the user's fingers when fitted within the handle, resulting in discomfort to the user.

Another concept developed to assist the user in holding a smooth walled cup is the tapered cup holder disclosed in U.S. Pat. No. 2,028,566. This cup holder comprises a ring to be fitted around the container as a sleeve. The ring is made of a strip of corrugated paper wherein the ends of the paper strip are overlapped and secured together along a side seam to form the ring. While the corrugations formed by this cup holder provide a means for better grasping the outside of the cup, the voids formed by the corrugations may also hold heat emanating from the cup causing the cup holder itself to become hot and difficult to handle. Insofar as the holder is made of corrugated paper, the holder may become compressed or "scrunched up" over time forming a relatively narrow strip around which the user may grasp the holder. Furthermore, the adhesive used to form the side seam may cause the holders to stick together when stacked for storage and may attract dirt or dust during storage.

SUMMARY OF THE INVENTION

In view of the foregoing, it is an object of the present invention to provide an insulating sleeve which may be fitted around a cup to enable the user to more easily grasp and hold the cup and to insulate the user's hand against heat or cold emanating from the cup.

Yet another object of the present invention is to provide such an insulating sleeve which may be conveniently fitted around a cup without any extensive assembly steps and without using any fastening tools or means, and without the use of adhesives.

It is another object of the present invention to provide such an insulating sleeve wherein the sleeve includes a means for venting hot or cold air away from the sleeve so as to prevent the sleeve from getting excessively hot or cold as to result in discomfort to the user.

Yet another object of the present invention is to provide such an insulating sleeve which is relatively inexpensive to manufacture and which may be easily dispensed for use from a stacked configuration.

A further object of the present invention is to provide such an insulating sleeve that is made of a unitary piece of plastic material.

A related object of the present invention is to provide such an insulating sleeve wherein the sleeve is unitary, seamless and transparent in nature such that indicia and graphics on the cup can be viewed through the sleeve.

Yet a further object of the present invention is to provide such an insulating sleeve for use with a tapered cup such that the sleeve snugly conforms to the tapered shape of the cup and enables the user to comfortably grasp and hold the cup for use.

These and other objects are achieved by an insulating sleeve adapted to slidably receive and securely engage the outer sidewall of a container such as a cup. The sleeve is comprised of a plurality of concentric ring-like bands aligned one above the other around a central longitudinal axis, wherein the bands are connected by peripheral ridges horizontally extending from the bottom edge of one band to the top edge of the next adjacent band to form an integral sleeve.

The sleeve is configured such that the top edge of each band rests in abutting engagement or contact with the container sidewall when fitted around the container. The remainder of the band and the peripheral ridge are positioned remote from contact with the container sidewall. In this manner, a void or channel is formed around the container between the sidewall and the band within an area defined by the top edge of the band and the top edge of the next adjacent band. This channel serves to insulate a large portion of the surface area of the sleeve from direct contact with the container sidewall. Vents provided within the top edge of each band allow air and/or vapor to flow between these channels such that hot or cold air accumulated within the channels is vented out the top of the sleeve.

In one embodiment of the invention, each band is slanted outwardly from top to bottom so as to form an acute angle with the longitudinal axis of the sleeve. The top edge of each band, conforming in size and shape to a corresponding portion of the container sidewall, rests in abutting engagement or contact with the sidewall when the container is received within the sleeve. The remainder of the band and the associated ridge are positioned remote from contact with the sidewall due to the slanted angle of the band, thereby forming a circular void or channel between the sidewall and that portion of the band and associated ridge not in contact with the sidewall.

In another embodiment of the invention particularly adapted for use with a tapered container, the diameter of the top edge of each band decreases incrementally from the upper-most band to the lower-most band so as to conform in size to a corresponding portion of the sidewall and to rest in abutting engagement with the sidewall. The remainder of the band and the associated ridge are positioned remote from contact with the sidewall due to the slanted angle of the sidewall, thereby forming a void or channel between the sidewall and the sleeve. In this embodiment, the bands may extend vertically from top to bottom parallel the longitudinal axis of the sleeve, or preferably, will be slanted outward at an acute angle from top to bottom as described above.

In an optional embodiment, one of the upper-most bands, preferably the third or fourth band from the top, is slanted outward at a greater angle than the remaining bands so as to form an outwardly protruding ledge under which the user may grasp and hold the container.

BRIEF DESCRIPTION OF TEE DRAWINGS

DETAILED DESCRIPTION OF THE DRAWINGS

Figure 1:
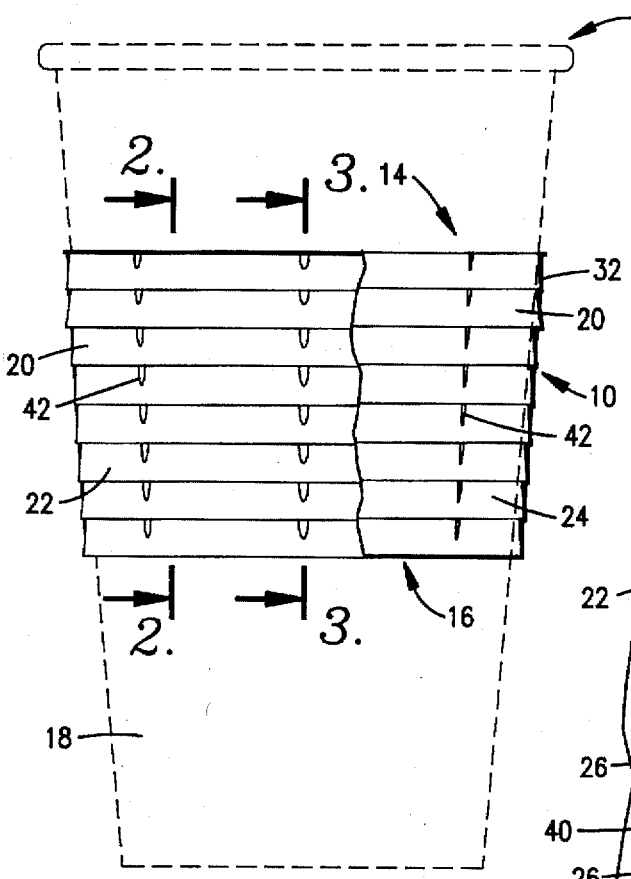
FIG. 1 is a side cut-away view showing the inner and outer face of a sleeve in accordance with the present invention when the sleeve is fitted around a cup, the cup being shown in dotted lines.

An insulating sleeve in accordance with a preferred embodiment of the present invention is represented by the numeral 10 in FIG. 1. Insulating sleeve 10 may be used in conjunction with any conventional container 12 having a generally smooth cylindrical or tapered sidewall and no handle. The insulating sleeve of the present invention is particularly adapted for use with beverage cups, wherein the sleeve is fitted around the cup to serve as a means for grasping and holding the cup. The sleeve is preferably of a unitary and seamless nature made of any relatively thin flexible material. Most preferably, the sleeve is made of a moldable plastic material including polyethylene or polypropylene, which may be relatively transparent so as to allow the user to view indicia on the container through the sleeve.

Sleeve 10 having an open top 14 and an open bottom 16 is configured to generally conform in shape to the outer sidewall 18 of container 12 and to securely fit around the container when received within the sleeve. Sleeve 10 comprises a plurality of concentric ring-like bands 20 aligned one above the other around a central longitudinal axis. Each band 20 comprises a relatively planar strip of material formed as a ring having an inner face 22 intended to face sidewall 18 when fitted around the container and an outer face 24.

Figure 2:
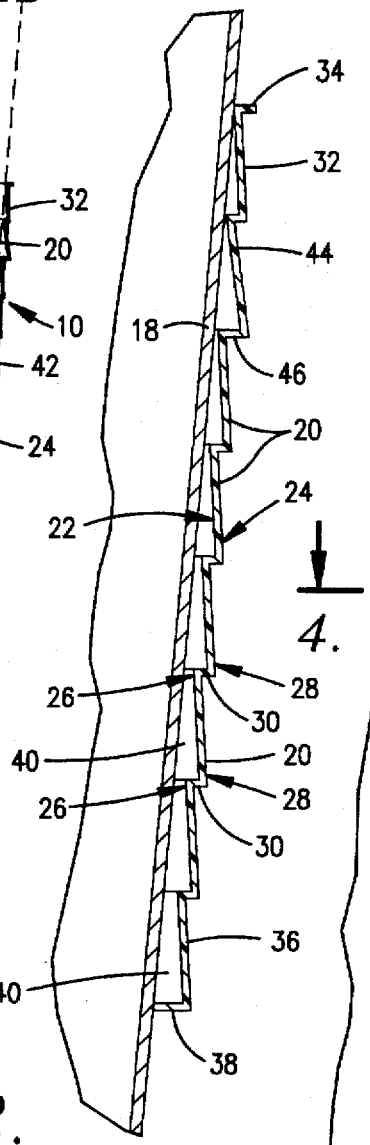
FIG. 2 is a fragmented sectional view taken along line 2—2 of FIG. 1.

Looking to FIG. 2, each band 20 is slanted outwardly from top to bottom so as to form an acute angle with the longitudinal axis of the sleeve. In this manner, the diameter of the top edge 26 of the band is less than the diameter of the bottom edge 28 of the band. The degree of angle by which the band is slanted may vary depending upon the desired appearance of the sleeve and upon the configuration of the container (e.g. cylindrical or tapered sidewall). The degree of angle will normally be 45° or less, and preferably ranges from 1° to 10°, with 1° to 5° being most preferred when made for use with a tapered container as shown in FIG. 1.

Bands 20 are connected to one another to form the integral sleeve 10 by peripheral ridges 30 horizontally extending inward from the bottom edge 28 of one band to the top edge 26 of the next adjacent band. Upper-most band 32 includes an outwardly extending peripheral lip 34 to assist the user in grasping the sleeve from a stacked configuration. The lower-most band 36 includes a bottom peripheral shelf 38 extending horizontally inward from the bottom edge of the band to form the open bottom 16. Open bottom 16 is preferably of equal or lesser diameter than a corresponding portion of sidewall 18 so that the inside edge of the lower-most ledge 38 fits tightly around sidewall 18 when placed around the container.

Figure 3:
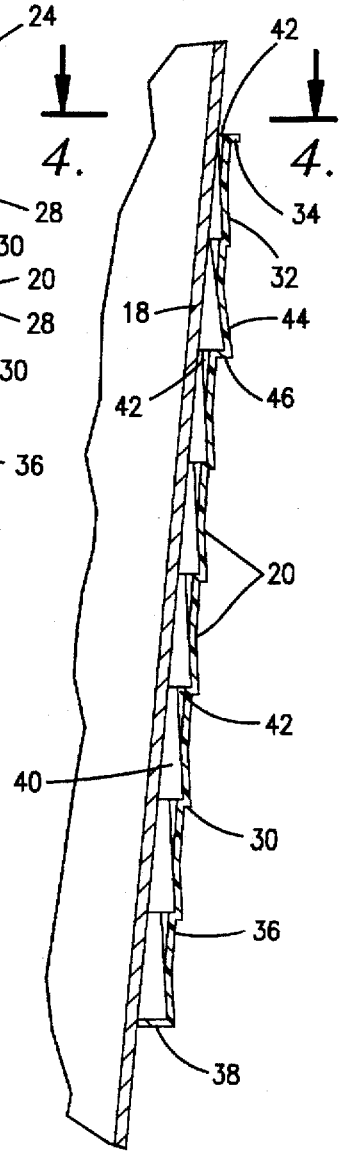
FIG. 3 is a fragmented sectional view taken along line 3—3 of FIG. 1.

The top edge 26 of each band generally conforms in size and shape to a corresponding portion of sidewall 18 such that top edge 26 rests in abutting engagement or contact with the sidewall when the container is received within the sleeve. If container 12 is tapered as shown in FIGS. 1–3, the diameter of the top edge 26 of each band incrementally decreases from upper-most band 32 to lower-most band 36 so as to conform in shape to the container. The remaining portion of band 20 and the associated ridge 30 are positioned remote from contact with sidewall 18 so as to define a void or channel 40 around sidewall 18 when container 12 is received within the sleeve. Channel 40 provides a space between sidewall 18 and band 10 within an area bounded by the top edge 26 of one band and the top edge 26 of the next adjacent band. A large portion of the inner surface area of sleeve 10 is therefore prevented from directly contacting sidewall 18, such that sleeve 10 is insulated from heat or cold emanating from container 12.

Figure 4:
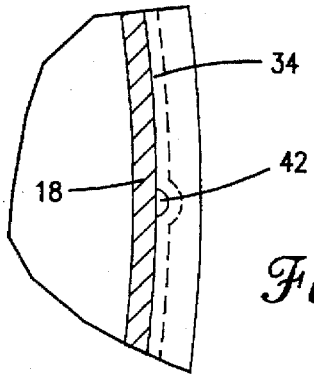
FIG. 4 is a fragmented top sectional view taken along line 4—4 of FIG. 3.

Wedge-shaped vents 42 provided along the top edge 26 of each band allow air and/or vapors to flow between channels 40 and to be vented out the top of sleeve 10. As best shown in FIGS. 3 and 4, each vent 42 comprises an outwardly protruding wedge-shaped notch formed within the top edge of a band. Vents 42 are configured so as to provide an air and/or vapor passageway between that area where sidewall 18 and the top edge 26 of the band rest in abutting engagement so as to allow air or vapors to flow from one channel to another. At least one vent 42 provided along the top edge 26 of upper-most band 32 allows the air or vapors to be vented out the top of sleeve 10. In this manner, hot or cold air accumulating between sleeve 10 and sidewall 18 within channels 40 can be vented away from the sleeve and container so as to prevent the sleeve from becoming excessively hot or cold.

In a preferred embodiment, a plurality of vents 40 are aligned one above the other to form a vertical row of vents as shown in FIG. 1 so as to accommodate air and/or vapor flow between the channels from the lower-most band 36 out the top of upper-most band 32. Most preferably, a plurality of spaced apart vertical rows of vents as shown in FIG. 1 are provided so as to enhance the venting process.

In an optional embodiment of the invention, an upper band 44, preferably the second or third band from upper-most band 32, may be slanted outwardly from top to bottom at an acute angle from the longitudinal axis of the sleeve that is greater and more severe when the angle of the remaining bands. In this manner, the peripheral ridge extending from the bottom edge of band 44 to the top edge of the next adjacent band forms an outwardly protruding ledge 46 under which the user may comfortably grasp the sleeve.

It is to be understood that although the invention disclosed herein with reference to the drawings is fully capable of achieving the objects and providing the advantages mentioned heretofore, the structural and operational characteristics of the invention as described are merely illustrative of a preferred embodiment. Accordingly, the scope of rights and privileges in the invention is not to be limited by the details of construction described. Instead reasonable equivalents, adaptations, modifications, and alternate forms of the preferred embodiment described above are included within the scope of this invention as defined by the claims.

For example, it is contemplated that a sleeve meeting the objectives of the present invention may be configured for use with a cylindrical rather than tapered container. In such a case, the top edges of each band will be vertically aligned one above the other to rest in abutting engagement with the container sidewall. The bands will be angled such that the remainder of the band will be remote from contact with the sidewall to form a circular void between the sidewall and the band. It is likewise contemplated that a sleeve meeting the objectives of the present invention could be configured for use with a tapered container wherein the bands are not angled, but instead extend from top to bottom parallel the longitudinal axis of the sleeve. In this embodiment, the top edge of each band would have a different diameter corresponding with a portion of the sidewall such that only the top edge of each band comes into contact with the tapered sidewall. A circular void or channel as described above would be formed between the remainder of the band and the container sidewall.

I claim:

1. A sleeve adapted to slidably receive and engage the outer sidewall of a container, wherein said sleeve comprises:

a plurality of concentric ring-like bands aligned one above the other around a central longitudinal axis of the sleeve wherein each band is connected to a next adjacent band by an associated peripheral ridge extending from a bottom edge of the band to a top edge of the next adjacent band, each band and associated peripheral ridge defining a channel between the band and a corresponding portion of the sidewall when the container is received within the sleeve; and a plurality of vents formed within the sleeve to enable air and/or vapor flow between said channels and to enable said air and/or vapor to be vented outwardly away from the sleeve.

2. A sleeve in accordance with claim 1, wherein said sleeve is made of a plastic material.

3. A sleeve in accordance with claim 2, wherein said sleeve is seamless and unitary in nature.

4. A sleeve in accordance with claim 2, wherein said plastic material is selected from the group consisting of polyethylene, polypropylene, and mixtures thereof.

5. A sleeve in accordance with claim 3, wherein said sleeve is made of a transparent material.

6. A sleeve adapted to slidably receive and engage the outer sidewall of a container, wherein said sleeve comprises:

a plurality of concentric ring-like bands aligned one above the other around a central longitudinal axis, wherein each band is formed of a planar strip having a top edge and a bottom edge and wherein each of said bands is connected to one another by an associated peripheral ridge extending from the bottom edge of one band to the top edge of a next adjacent band; and wherein the top edge of each band is configured to rest in abutting engagement with the sidewall when the container is received within the sleeve while the remaining portion of the band and said associated ridge are configured to lie remote from contact with the sidewall when the container is received within the sleeve such that a channel is formed between the band and the sidewall within an area defined by the upper edge of the band and the upper edge of the next adjacent band.

7. A sleeve in accordance with claim 6, wherein said sleeve additionally comprises a plurality of vents formed within the top edge of one or more bands to enable air and/or vapor flow between said channels.

8. A sleeve in accordance with claim 7, wherein at least one vent is provided in the top edge of an uppermost band of the sleeve to enable air and/or vapor to be vented outwardly from the top of the sleeve.

9. A sleeve in accordance with claim 8, wherein said plurality of vents are vertically aligned one above the other to permit air flow between said channels and out the at least one vent in the upper-most band.

10. A sleeve in accordance with claim 6, wherein each of said bands is slanted outwardly from the top edge to the bottom edge of the band to form an acute angle with the longitudinal axis of the sleeve such that the diameter of the band along the top edge of the band is less than the diameter of the band along the bottom edge of the band.

11. A sleeve in accordance with claim 6, wherein said sleeve is tapered to conform to the shape of the outer sidewall of a tapered container.

12. A sleeve in accordance with claim 6, wherein the diameter of the top edge of each of said bands incrementally decreases from the upper-most band to a lower-most band.

13. A sleeve in accordance with claim 12, wherein each of said bands is slanted outwardly from the top edge to the bottom edge to form an acute angle with the central longitudinal axis of the sleeve such that the top edge of each band has a smaller diameter than the bottom edge of the band.

14. A sleeve in accordance with claim 10, wherein one of said bands is slanted at an angle greater than the angle of the remaining bands so as to form an outwardly protruding ridge under which a user may grasp the sleeve and hold the container.

15. A sleeve in accordance with claim 14, wherein said protruding ridge is formed along an upper band of said sleeve.

* * * * *